US006613153B1

(12) United States Patent
Bertholdt et al.

(10) Patent No.: US 6,613,153 B1
(45) Date of Patent: Sep. 2, 2003

(54) METHOD FOR REDUCING THE RADIOACTIVITY OF METAL PART

(75) Inventors: Horst-Otto Bertholdt, Forchheim (DE); Rainer Gassen, Fürth (DE); Franz Strohmer, Bamberg (DE)

(73) Assignee: Framatome ANP GmbH, Erlangen (DE)

( * ) Notice: Subject to any disclaimer, the term of this patent is extended or adjusted under 35 U.S.C. 154(b) by 0 days.

(21) Appl. No.: 09/699,320

(22) Filed: Oct. 27, 2000

Related U.S. Application Data

(63) Continuation of application No. PCT/DE99/01203, filed on Apr. 21, 1999.

(30) Foreign Application Priority Data

Apr. 27, 1998 (DE) ..... 198 18 772

(51) Int. Cl.[7] ..... C23G 1/02

(52) U.S. Cl. ..... 134/2; 134/3; 134/22.1; 134/22.11; 134/26; 134/28; 134/36; 134/41; 134/42; 204/157.15; 588/1

(58) Field of Search ..... 588/1; 204/157.15; 134/2, 3, 22.1, 22.11, 26, 28, 36, 41, 42

(56) References Cited

U.S. PATENT DOCUMENTS

| | | | | | |
|---|---|---|---|---|---|
| 4,226,640 | A | * | 10/1980 | Bertholdt | 134/3 |
| 4,470,951 | A | * | 9/1984 | Bradbury et al. | 376/310 |
| 4,537,666 | A | | 8/1985 | Murray et al. | 204/129.95 |
| 4,704,235 | A | * | 11/1987 | Arvesen | 252/626 |
| 4,705,573 | A | * | 11/1987 | Wood et al. | 134/3 |
| 4,710,318 | A | * | 12/1987 | Horiuchi et al. | 252/628 |
| 4,731,124 | A | * | 3/1988 | Bradbury et al. | 134/3 |
| 4,756,768 | A | * | 7/1988 | Bertholdt et al. | 134/3 |
| 4,942,594 | A | * | 7/1990 | Bertholdt et al. | 376/310 |
| 5,045,273 | A | * | 9/1991 | Gassen et al. | 376/309 |
| 5,078,894 | A | * | 1/1992 | Horwitz et al. | 252/81 |
| 5,082,603 | A | * | 1/1992 | Horie et al. | 252/628 |
| 5,135,709 | A | * | 8/1992 | Andresen et al. | 376/305 |
| 5,523,513 | A | * | 6/1996 | Milner | 588/1 |
| 5,587,142 | A | * | 12/1996 | Horwitz et al. | 423/658.5 |
| 5,835,865 | A | * | 11/1998 | Bertholdt et al. | 588/1 |
| 5,958,247 | A | * | 9/1999 | Bertholdt et al. | 210/668 |
| 6,147,274 | A | * | 11/2000 | Wood et al. | 588/1 |

FOREIGN PATENT DOCUMENTS

| | | |
|---|---|---|
| EP | 0 071 336 A1 | 2/1983 |
| EP | 0 355 628 A1 | 2/1990 |
| EP | 0 406 098 A1 | 1/1991 |
| FR | 2 644 618 | 9/1990 |
| FR | 2 699 936 | 7/1994 |

OTHER PUBLICATIONS

International Search Report and International Preliminary Examination Report for PCT/DE99/01203.*
Published International Application No. WO 97/44793 (Milner et al.), dated Nov. 27, 1997.

* cited by examiner

*Primary Examiner*—Sharidan Carrillo
(74) *Attorney, Agent, or Firm*—Laurence A. Greenberg; Werner H. Stemer; Ralph E. Locher

(57) ABSTRACT

The radioactivity of a metal part is reduced in the process. In the method, firstly a layer of oxide is removed from the metal part using a decontamination solution. Then, an agent which has an oxidizing action and is still present is removed from the decontamination solution. As a result, a layer of the metal is removed. Since radionuclides are to be found only in the layer of the metal part which is close to the surface, the remaining metal can be scrapped in the conventional way.

14 Claims, 1 Drawing Sheet

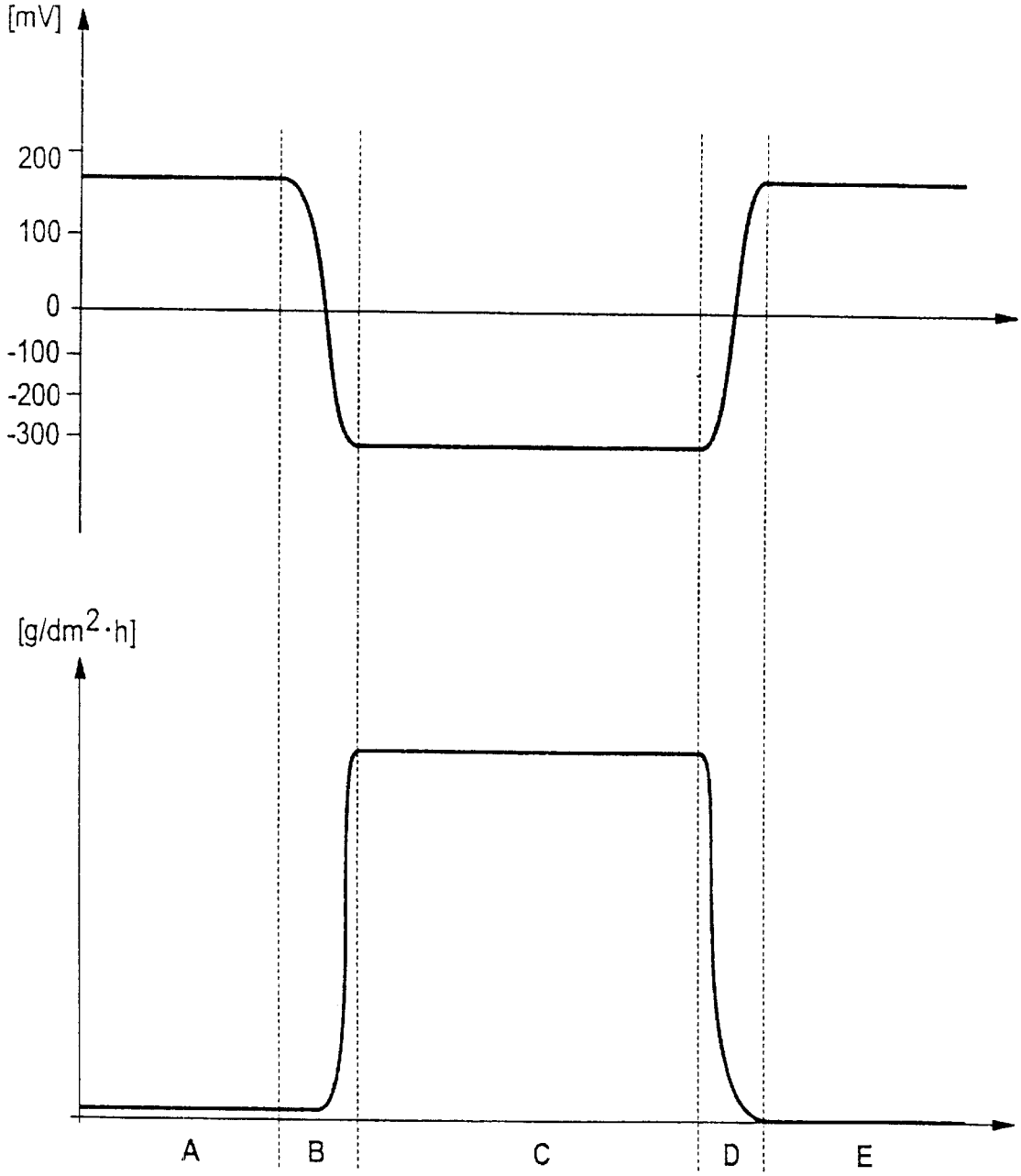
[mV]
200
100
0
-100
-200
-300
[g/dm2·h]
A
B
C
D
E

METHOD FOR REDUCING THE RADIOACTIVITY OF METAL PART

CROSS-REFERENCE TO RELATED APPLICATION

This is a continuation of international application PCT/DE99/01203, filed Apr. 21, 1999, which designated the United States.

BACKGROUND OF THE INVENTION

Field of the Invention

The invention relates to a method for reducing the radioactivity of a metal part, in which an oxide layer is removed from the metal part using a decontamination solution.

A method for the chemical decontamination of surfaces of metallic components of nuclear reactor plants is known, for example, from EP 0 355 628 B1. The aim of a method of this type is to eliminate a radioactively contaminated oxide layer from the surface of metallic components. For this purpose, the decontamination solution used may be a solution which contains, for example, oxalic acid or some other carboxylic acid.

During the prolonged operating life of a nuclear power plant, radionuclides accumulate primarily in the oxidic protective layers which are to be found on the surfaces of metallic components. Consequently, for decontamination work during a customary inspection of a nuclear power plant, it is sufficient to remove the oxide layer. To do this, a suitable decontamination solution is selected in such a way that the base metal of the components is not attacked.

This procedure is appropriate for an inspection, since approx. 98% of the radionuclides are to be found in the oxide layer. Only approx. 2% of the radionuclides diffuse into regions close to the surface of the base metal of which the components are formed.

When components of a nuclear power plant are being replaced or when the plant is being shut down, the approx. 2% of the radionuclides which have diffused into the surface region of the base metal cause the metal to be placed in an ultimate storage site even after decontamination.

Since very large amounts of metal are produced, a very large ultimate storage site would be required, and this is uneconomical.

SUMMARY OF THE INVENTION

It is accordingly an object of the invention to provide a method of removing radionuclides from radioactively contaminated metal that overcomes the above-mentioned disadvantages of the prior art methods of this general type, so that this metal can be treated as inactive scrap in the standard materials circuit.

With the foregoing and other objects in view, there is provided, according to the invention, a method for reducing the radioactivity of a metal part, which comprises removing an oxide layer from the metal part using a decontamination solution, removing one or more agents which have an oxidizing action from the decontamination solution, lowering the redox potential of the solution and the corrosion potential of the metal of which the metal part consists, and thereby removing a layer of the metal.

The removal of one or more agents which have an oxidizing action lowers the redox potential in the decontamination solution and also reduces the corrosion potential of the base metal. Consequently, a controlled attack is carried out on the base metal. In the process, a few micrometers of the base metal are removed.

Since the radionuclides which have penetrated into a the metal by diffusion are to be found only in regions of the metal which are close to the surface, the method according to the invention results in the advantage that the radionuclides are separated from the metal by the controlled attack on the base metal. What remains is advantageously scrap metal which can be treated further in the same way as conventional inactive scrap. On the other hand, no more base metal than necessary is removed, so that only a small amount of waste has to be delivered to an ultimate storage site.

Agents which have an oxidizing action and are removed from the decontamination solution include, for example $Fe^{3+}$ and/or residual oxygen. The $Fe^{3+}$ which has an oxidizing action emanates from the oxide layer which has been separated from the metal surface in a preceding decontamination step.

To remove agents which have an oxidizing action, a reducing agent can be added to the decontamination solution. A reducing agent of this type can be used to convert the disruptive $Fe^{3+}$ into $Fe^{2+}$, which does not cause a problem. Such a reducing agent can be, for example, ascorbic acid.

To remove agents which have an oxidizing action and are generally gases, it is also possible to pass an inert gas through the decontamination solution. As a result, the residual oxygen which is still present is expelled. One example of a suitable inert gas is nitrogen.

According to a particularly advantageous refinement of the method, the decontamination solution is irradiated with UV light in order to remove agents which have an oxidizing action. This results in the advantage that both disruptive $Fe^{3+}$ and disruptive residual oxygen can be removed with the aid of an organic decontamination acid which, on account of the preceding decontamination step, is still present in the decontamination solution.

Under UV irradiation, $Fe^{2+}$ and carbon dioxide are formed from the disruptive $Fe^{3+}$ and organic decontamination acid which is present. The $Fe^{2+}$ which is formed in this way and organic decontamination acid which is present, together with the disruptive residual oxygen, under UV irradiation then form $Fe^{3+}$ and carbon dioxide. This reaction proceeds until there is no longer any oxygen present. The $Fe^{3+}$ formed is then converted into $Fe^{2+}$ and carbon dioxide according to the first reaction described, so that then only these two substances, and no agents which have an oxidizing action, remain.

By way of example, $Fe^{2+}$ ions which form are removed using a cation exchanger. A cation exchanger advantageously has a very high capacity. For this reason, a small ion exchanger is sufficient. In fact, for direct removal of $Fe^{3+}$ ions, since $Fe^{3+}$ forms organic complexes with organic decontamination acids, for example an oxalate complex, an anion exchanger would be necessary, the capacity of which is considerably lower than that of a cation exchanger. Furthermore, the conversion of $Fe^{3+}$ into $Fe^{2+}$ has the advantage that the remaining decontamination solution to be disposed of does not contain any chelates (chelate complexes), which would have to be eliminated at high cost.

To improve the removal of base metal, nitric acid may additionally be added to the decontamination solution, for example in a concentration of from 100 ppm to 10, 000 ppm in the solution.

By way of example, the method for removing agents which have an oxidizing action is not continued until there are no longer any agents which have an oxidizing action present. To this end, the removal is stopped, for example through the addition of an oxidizing agent. The oxidizing agent may, for example, be air, oxygen, iron(3) ions, hydrogen peroxide and/or ozone.

Stopping the removal of agents which have an oxidizing action has the advantage that it is possible to remove only a desired, very thin layer from the base metal. This is because it has been found that the radionuclides only penetrate into the base metal down to a depth of a few tens of micrometers by diffusion, i.e. by the exchange of lattice sites in the metal lattice. By way of example, the removal of agents which have an oxidizing action from the decontamination solution is initiated and stopped in an alternating sequence. If the switch from initiation and stopping of the attack on the base metal takes place as quickly as possible, it is particularly advantageously possible to remove only precisely that amount of metal which contains the radionuclides present in the region close to the surface. Advantageously, the treatment time and also the amount of waste which has to be disposed of in an ultimate storage site are greatly minimized. The removal of base metal can be controlled by switching between initiation and stopping in individual steps of up to a tenth of a micrometer. Depending on requirements, it is then possible to remove metal to a few hundreds of micrometers or even less.

The method according to the invention has the particular advantage that radioactively contaminated metal parts, following the treatment, can be recycled as usual as uncontaminated scrap and do not have to be stored in an ultimate storage site.

Other features which are considered as characteristic for the invention are set forth in the appended claims.

Although the invention is illustrated and described herein as embodied in a method for reducing the radioactivity of a metal part, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing, at the top, shows the curve of the corrosion potential of a metal part from the initiation of the removal of agents which have an oxidizing action from the decontamination solution until the process is stopped. The lower curve shows the simultaneous attack on the base metal.

DESCRIPTION OF THE PREFERRED EMBODIMENTS

During a standard decontamination method without any attack on the base metal (period A), the corrosion potential is approximately 200 mV. In this period A, there is virtually no attack on the base metal, since such attack is undesirable during a standard decontamination method. In the subsequent period B, a UV treatment takes place, so that the corrosion potential falls to approximately −300 mV and the attack on the base metal rises, initially slowly and then very quickly. In the following period C, the desired attack on the base metal takes place, with the result that at least part of the radionuclide-containing layer of the metal part is removed. In the subsequent period D, the attack on the base metal is stopped by the addition of hydrogen peroxide. The corrosion potential rises again to almost 200 mV and the attack on the base metal drops back to a negligible level. In the subsequent period E, the base metal can be passivated. However, in this period it is also possible to determine whether sufficient metal has been removed. If necessary, the method described can be repeated a number of times until the remaining metal is free of radionuclides and can be scrapped in the conventional way.

We claim:

1. A method of removing radionuclides from a radioactively contaminated metal, which comprises a) providing a radioactively contaminated metal having an oxide layer and a base metal layer, wherein radionuclides are present in both the oxide layer and the base metal layer;

b) providing a decontamination solution comprising a carboxylic acid;

c) removing the oxide layer containing the radionuclides by treating the radioactively contaminated metal with the decontamination solution, thereby generating an oxidizing agent in the decontamination solution;

d) lowering the redox potential of the decontamination solution and reducing the corrosion potential of the base metal layer by removing the oxidizing agent from the decontamination solution, thereby allowing a controlled amount of the base metal layer to be removed by the decontamination solution; and e) removing a controlled amount of the base metal layer containing the radionuclides by treating the base metal layer with the decontamination solution having a lowered redox potential.

2. The method according to claim 1, wherein the oxidizing agent is $Fe^{3+}$.

3. The method according to claim 1, wherein the oxidizing agent comprises oxygen and step (d) comprises passing an inert gas through the decontamination solution to remove the oxygen.

4. The method according to claim 1, wherein the oxidizing agent is selected from the group consisting of oxygen and $Fe^{3+}$ and step (d) comprises irradiating the decontamination solution with UV light to remove the oxidizing agent.

5. The method according to claim 1, which comprises adding nitric acid to the decontamination solution to improve the removal of the base metal layer.

6. The method according to claim 1, which further comprises controlling the removal of the base metal layer by the decontamination solution by adding an oxidizing agent to the decontamination solution.

7. The method according to claim 1, wherein the agent which has an oxidizing action is oxygen.

8. The method according to claim 2, wherein step (d) comprises adding a reducing agent to the decontamination solution to convert $Fe^{3+}$ to $Fe^{2+}$.

9. The method according to claim 4, wherein the agent which has an oxidizing action is oxygen.

10. The method according to claim 4, wherein the agent which has an oxidizing action is $Fe^{3+}$.

11. The method according to claims 6, wherein the oxidizing agent is selected from the group consisting of air, oxygen, iron(3) ion, hydrogen peroxide, and ozone.

12. The method according to claim 8, wherein the reducing agent is ascorbic acid.

13. The method according to claim 8, which comprises removing $Fe^{2+}$ using a cation exchanger.

14. The method according to claimed 11, which comprises adding and removing the oxidizing agent to the decontaminating solution in an alternating sequence.

* * * * *